US008695499B2

(12) United States Patent
Pisarski

(10) Patent No.: US 8,695,499 B2
(45) Date of Patent: Apr. 15, 2014

(54) METHOD FOR SETTING UP AN INK FOUNTAIN OF A PRINTING PRESS AND PRINTING PRESS HAVING AN INK FOUNTAIN

(75) Inventor: Rafael Pisarski, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 519 days.

(21) Appl. No.: 12/367,708

(22) Filed: Feb. 9, 2009

(65) Prior Publication Data

US 2009/0199731 A1 Aug. 13, 2009

(30) Foreign Application Priority Data

Feb. 8, 2008 (DE) ..... 10 2008 008 110

(51) Int. Cl.
*B41F 31/02* (2006.01)

(52) U.S. Cl.
USPC ..... 101/210; 101/208; 101/364

(58) Field of Classification Search
CPC ..... B41J 31/02; B41J 31/06; B41J 7/32
USPC ..... 101/207, 351.2, 352.02, 352.03, 364, 101/208, 221, 350.1
See application file for complete search history.

(56) References Cited

U.S. PATENT DOCUMENTS

| | | | | |
|---|---|---|---|---|
| 4,242,958 | A * | 1/1981 | Jeschke | 101/365 |
| 4,400,686 | A * | 8/1983 | Pitcher | 338/184 |
| 4,414,900 | A * | 11/1983 | Kraus et al. | 101/363 |
| 5,058,502 | A | 10/1991 | Kobler et al. | |
| 5,862,756 | A | 1/1999 | Gorter | |
| 6,349,645 | B1 * | 2/2002 | Roskosch | 101/364 |
| 6,772,684 | B2 * | 8/2004 | Kanayama | 101/350.1 |
| 7,117,791 | B2 * | 10/2006 | Matsuura | 101/350.5 |
| 2006/0054677 | A1 * | 3/2006 | Africa | 232/17 |

FOREIGN PATENT DOCUMENTS

| | | | |
|---|---|---|---|
| CN | 2931112 | Y | 8/2007 |
| DE | 30 43 234 | A1 | 7/1982 |
| DE | 37 04 433 | A1 | 8/1988 |
| DE | 196 31 301 | A1 | 2/1998 |
| DE | 199 49 346 | A1 | 4/2001 |
| DE | 199 57 464 | A1 | 5/2001 |
| DE | 103 02 288 | A1 | 8/2004 |
| EP | 1 167 032 | A2 | 1/2002 |
| EP | 1 498 267 | A1 | 1/2005 |

OTHER PUBLICATIONS

German Patent and Trademark Office Search Report, dated Jun. 11, 2008.

* cited by examiner

*Primary Examiner* — Judy Nguyen
*Assistant Examiner* — Justin Olamit
(74) *Attorney, Agent, or Firm* — Laurence A. Greenberg; Werner H. Stemer; Ralph E. Locher

(57) ABSTRACT

A method for setting-up or making-ready an ink fountain of a printing press includes setting side walls of the ink fountain against an ink fountain roller of the ink fountain, while simultaneously tensioning or stressing springs so that the springs press the side walls against the ink fountain roller. A printing press including an ink fountain configured for performing the foregoing method is also provided.

5 Claims, 4 Drawing Sheets

METHOD FOR SETTING UP AN INK FOUNTAIN OF A PRINTING PRESS AND PRINTING PRESS HAVING AN INK FOUNTAIN

CROSS-REFERENCE TO RELATED APPLICATION

This application claims the priority, under 35 U.S.C. §119, of German Patent Application DE 10 2008 008 110.8, filed Feb. 8, 2008; the prior application is herewith incorporated by reference in its entirety.

BACKGROUND OF THE INVENTION

Field of the Invention

The present invention relates to a method for making ready or setting up an ink fountain of a printing press and a printing press having an ink fountain, in which the ink fountain includes a fountain roller and side walls which are brought into contact with or set against the fountain roller.

Ink fountains in offset printing presses typically include an ink fountain roller and a wedge-shaped unit, for which reason the ink fountains are also called wedge-shaped ink fountains. The wedge-shaped unit includes a so-called basic body forming the ink fountain bottom, and two side walls, which are so-called ink fountain cheeks, for laterally closing a space which is filled with printing ink. The side walls are placed onto the basic body of the ink fountain and are pivotable with the ink fountain. The unit is pivoted away from the ink fountain roller in order to open the ink fountain and to be able thereby to clean it better. The side walls are removed in order to clean the basic body and are remounted on the basic body after the latter has been cleaned. Thereafter, the unit is set against the ink fountain roller again, in order to close the ink fountain and in order for the unit to be able, subsequently, to fill the ink fountain with new printing ink. The assembly of the side walls on the basic body is quite time-intensive and complicated for the operator of the printing press.

That problem is solved neither by the ink fountain which is described in German Published, Non-Prosecuted Patent Application DE 199 57 464 A1, corresponding to U.S. Pat. No. 6,598,525, nor by the ink fountain which is described in European Patent Application EP 1 167 032 A2, corresponding to U.S. Pat. No. 6,772,684, nor by the ink fountain which is described in European Patent Application EP 1 498 267 A1, corresponding to U.S. Pat. No. 7,117,791.

SUMMARY OF THE INVENTION

It is accordingly an object of the invention to provide a method for making ready or setting up an ink fountain of a printing press and a printing press having an ink fountain, which overcome the hereinafore-mentioned disadvantages of the heretofore-known methods and devices of this general type and in which the method can be performed quickly and in an uncomplicated manner.

With the foregoing and other objects in view, there is provided, in accordance with the invention, a method for making ready or setting up an ink fountain of a printing press, in which the ink fountain has side walls and is provided with an ink fountain roller. The method comprises setting the side walls of the ink fountain against the ink fountain roller of the ink fountain and thereby tensioning or stressing springs so that the springs press the side walls against the ink fountain roller.

In accordance with another mode of the invention, the side walls are pressed against actuating elements loaded by the springs, when the side walls are set against the ink fountain roller, with the actuating elements being adjusted therewith counter to the action of the springs.

In accordance with a further mode of the invention, when the side walls are set against the ink fountain roller, the side walls are adjusted together with a basic body of the ink fountain, and before setting the side walls against the ink fountain roller, the side walls are placed onto the basic body of the ink fountain, and therewith are brought into only loose engagement with the actuating elements.

In accordance with an added mode of the invention, pockets of the side walls are pushed over transverse pins of the actuating elements when the side walls are placed onto the basic body, with the transverse pins being oriented transversely relative to the adjusting direction of the actuating elements.

In accordance with an additional mode of the invention, walls of the pockets are pressed against spherical heads of the transverse pins when the side walls are set against the ink fountain roller.

In accordance with yet another mode of the invention, the actuating elements are formed as slides.

In accordance with yet a further mode of the invention, the side walls are pressed against the slides when the side walls are set against the ink fountain roller, and the slides are accordingly displaced in a direction that is inclined relative to a bottom of the ink fountain.

In accordance with yet an added mode of the invention, the side walls are placed indirectly onto the basic body when the side walls are placed onto the basic body, in that the side walls are placed onto an ink fountain foil or film lying on the basic body.

In accordance with yet an additional mode of the invention, the side walls are pressed against the ink fountain film or foil by the springs when the side walls are set against the ink fountain roller.

With the objects of the invention in view, there is concomitantly provided a printing press, comprising an ink fountain configured for performing the method according to the invention.

In regard to the foregoing, it is noted that the operator or servicing personnel do not have to perform any complicated work steps at all, such as screwing on any components. The method can therefore also be performed very quickly. This is particularly advantageous for printing presses requiring a great number of printing units and ink fountains to be set up. Moreover, the method of the invention can be performed without tools.

In one development of the method of the invention, the side walls are pressed against actuating elements which are loaded by the springs, when the side walls are set against the ink fountain roller, with the result that the actuating elements are adjusted counter to the action of the springs. The tension or stress of the springs is thereby increased, so that the spring force thereof becomes sufficient for reliably holding the side walls on the ink fountain roller.

In a further development, the side walls are adjusted together with a basic body of the ink fountain when the side walls are set against the ink fountain roller. Together with the side walls, the basic body forms an adjustable unit which is pivoted, for example, in order to set the side walls against the ink fountain roller. Before the side walls are set against the ink fountain roller, the side walls are placed directly or indirectly onto the basic body and are accordingly brought into engagement with the actuating elements. In the course of this engagement, a great amount of play takes place, and the components are not secured by any clamping force. Accordingly, the actuating elements are only loosely in engagement with the side walls.

In a further development, pockets which are formed in the side walls are pushed loosely over transverse pins of the actuating elements when the side walls are placed onto the basic body. The transverse pins, respectively, have a longitudinal axis which extends transversely relative to the adjusting direction of the actuating elements. The transverse pins can be oriented parallel to the rotational axis of the ink fountain roller. The pockets can be blind holes or grooves.

In a further development, the transverse pins which are used have spherical heads. The pockets have walls, for example inner walls of the blind holes, the walls being pressed against the spherical heads of the transverse pins when the side walls are set against the ink fountain roller. The spherical nature of the pin heads makes it possible for the side walls to orient themselves relative to the ink fountain roller. This ensures a satisfactory sealing action between the side walls and the ink applicator roller.

In a further development, slides are used as the actuating elements. These slides are displaceable along a respective straight line which extends substantially perpendicularly relative to the rotational axis of the ink fountain roller. Although a possible configuration of the actuating elements as pivotable eccentrics is also conceivable, the configuration as slides is more advantageous in comparison with respect to functionality and manufacturing technology.

In a further development, setting the side walls against the ink fountain roller causes the side walls to be pressed against the slides and, as a result, the slides to be displaced in a direction which is oblique relative to a bottom of the ink fountain. Due to the oblique thrust direction of the slides, the springs loading the slides generate a force component in the direction of the basic body or the ink fountain bottom which is formed by the basic body, as a result of which a sufficiently great frictional force is generated between the side walls and the ink fountain bottom, in order to hold the side walls in the required position thereof.

According to a further development, the side walls are placed indirectly onto the basic body when they are placed thereon. When they are thus placed indirectly onto the basic body, the side walls are placed onto an ink fountain film or foil which lies on the basic body in order to line the ink fountain. The ink fountain film covers the ink fountain bottom which is formed by the basic body. The ink fountain film is advantageous with regard to quick cleaning of the ink fountain in the event of an ink change, with it being possible for the film which is contaminated with the old residual ink to be disposed of as a disposable article and to be replaced by a new film.

In a further development, the side walls are pressed against the ink fountain film or foil by the springs when the side walls including the entire unit are set against the ink fountain roll. This ensures the correct and fold-free position of the film within the ink fountain.

A printing press which is configured for carrying out the method according to the invention or a method which corresponds to one of the developments thereof also belongs to the invention.

Other features which are considered as characteristic for the invention are set forth in the appended claims.

Although the invention is illustrated and described herein as embodied in a method for setting up an ink fountain of a printing press and a printing press having an ink fountain, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
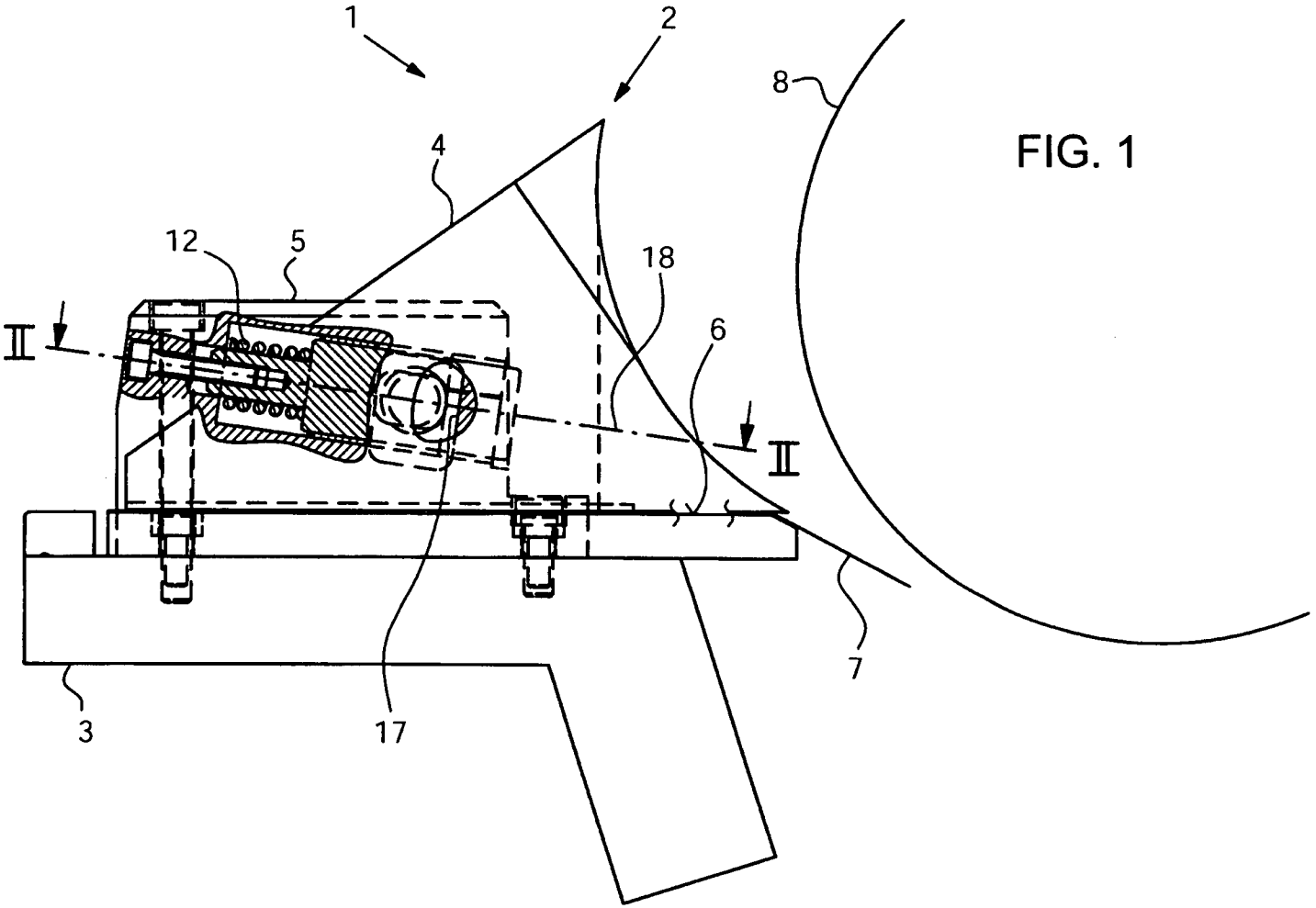
FIG. 1 is a fragmentary, diagrammatic, side-elevational view, partly in section, of an ink fountain having a basic body/side walls unit which is pivoted away from an ink fountain roller.

Referring now to the figures of the drawings in detail and first, particularly, to FIG. 1 thereof, there is seen a section of a printing press 1 for lithographic offset printing. The section includes an ink fountain 2 of the printing press 1. The ink fountain 2 includes a wedge-shaped unit having a multipartite basic body 3 with two side walls 4 disposed thereon, and two holders 5 for holding the side walls 4. In FIG. 1, only a rear side wall and a rear holder can be seen, whereas a front side wall and a front holder are not shown in the interest of improved clarity.

Figure 3:
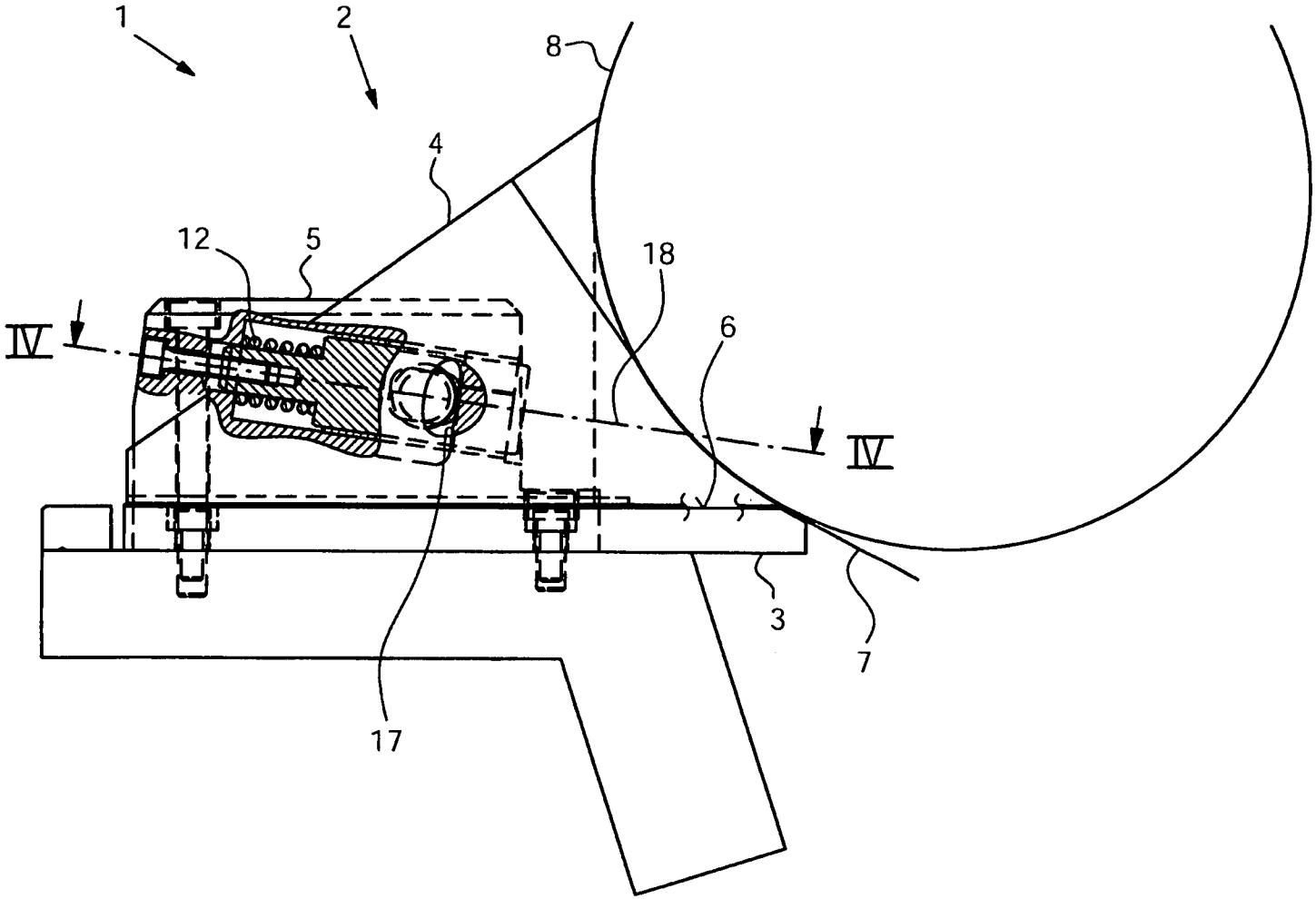
FIG. 3 is a fragmentary, side-elevational view, similar to FIG. 1, of the ink fountain having the basic body/side walls unit which is, however, pivoted toward and against the ink fountain roller.

The two side walls 4 are disposed between the two holders 5. The basic body 3 forms a bottom 6 of the ink fountain 2 and the bottom 6 has a foil or film 7 lying thereon. The foil or film 7 is disposed between the bottom 6 and the side walls 4 and serves to protect the bottom 6 against contamination by printing ink and to facilitate removal of residual ink from the ink fountain 2 during cleaning of the ink fountain 2. One of the side walls 4 is disposed at that end of the ink fountain 2 which lies on a drive side of the printing press 1, and the other side wall 4 is disposed at that end of the ink fountain 2 which lies on an operating side of the printing press 1. The side walls 4 close an inner space which receives the printing ink between the respective bottom 6 or film 7 which covers the latter, and an ink fountain roller 8 when the unit is set against the ink fountain roller 8, as is shown in FIG. 3.

Figure 2:
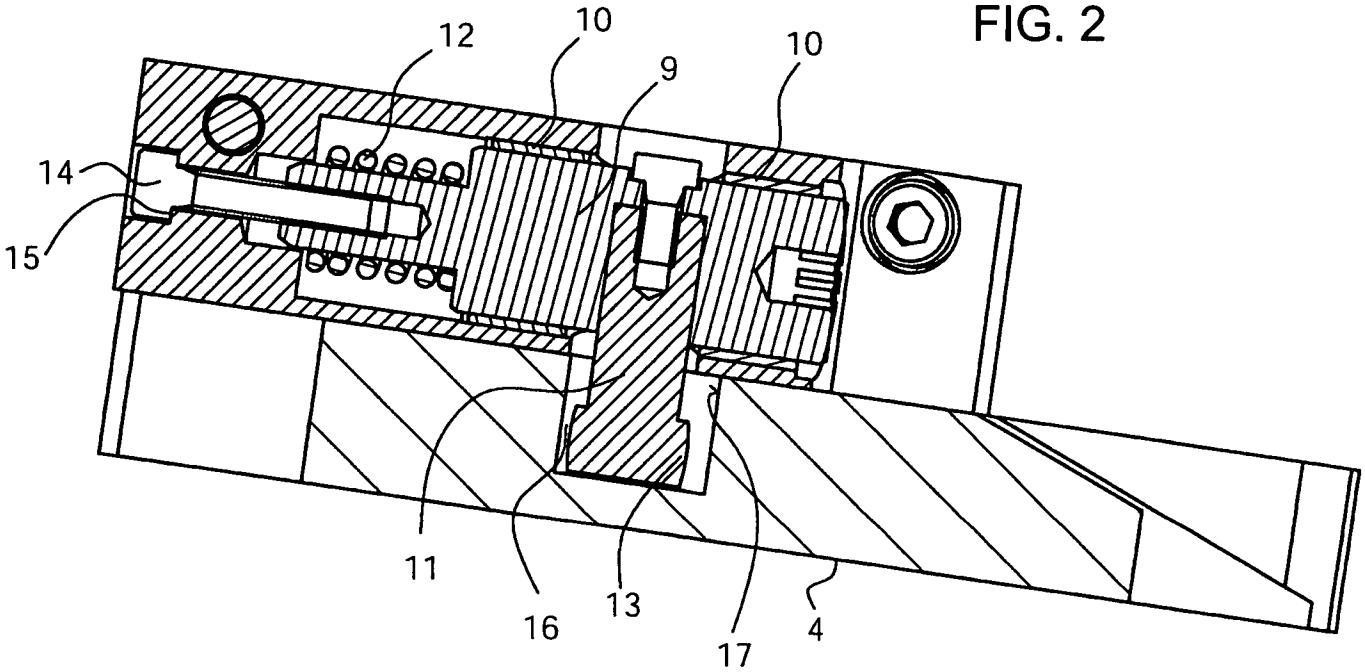
FIG. 2 is an enlarged, partly broken away and mainly sectional view of a side wall and an actuating element of the ink fountain, which is taken along a line II-II of FIG. 1, in the direction of the arrows.

FIG. 2 shows, by way of example, a holder 5, a side wall 4, the construction of the holders 5, which are mirror symmetrical with respect to one another, and the construction of the side walls 4, which are also mirror symmetrical with respect to one another. The holder 5, which is configured in the shape of a small block and is screwed to the basic body 3 (see FIG. 1), receives an actuating element 9 which is displaceably mounted as a slide in a linear guide. The linear guide includes two sliding bushings 10. The actuating element 9 is a pin and has a thick section and a thin section. The thick section is guided in the sliding bushing 10 and a transverse pin 11 is inserted in the thick section. A spring 12, which is seated on the thin section, is a helically wound compression spring and is supported at one end thereof on the holder 5 and at the other end thereof on the thick section of the actuating element 9.

The transverse pin 11 has a head 13 which is barrel-shaped. The generatrix of the head 13 therefore does not extend parallel to the longitudinal axis of the transverse pin 11, but rather convexly with respect to the latter, as can be seen in FIG. 2. The convex configuration of the actuating element 9 at the surface of its contact with the side wall 4 makes it possible for the latter to orient itself on the ink fountain roller 8 in a relatively unimpeded manner and therefore ensures a satisfactory sealing action between the concave end face of the side wall 4 and the circumferential face of the ink fountain roller 8.

Figure 4:
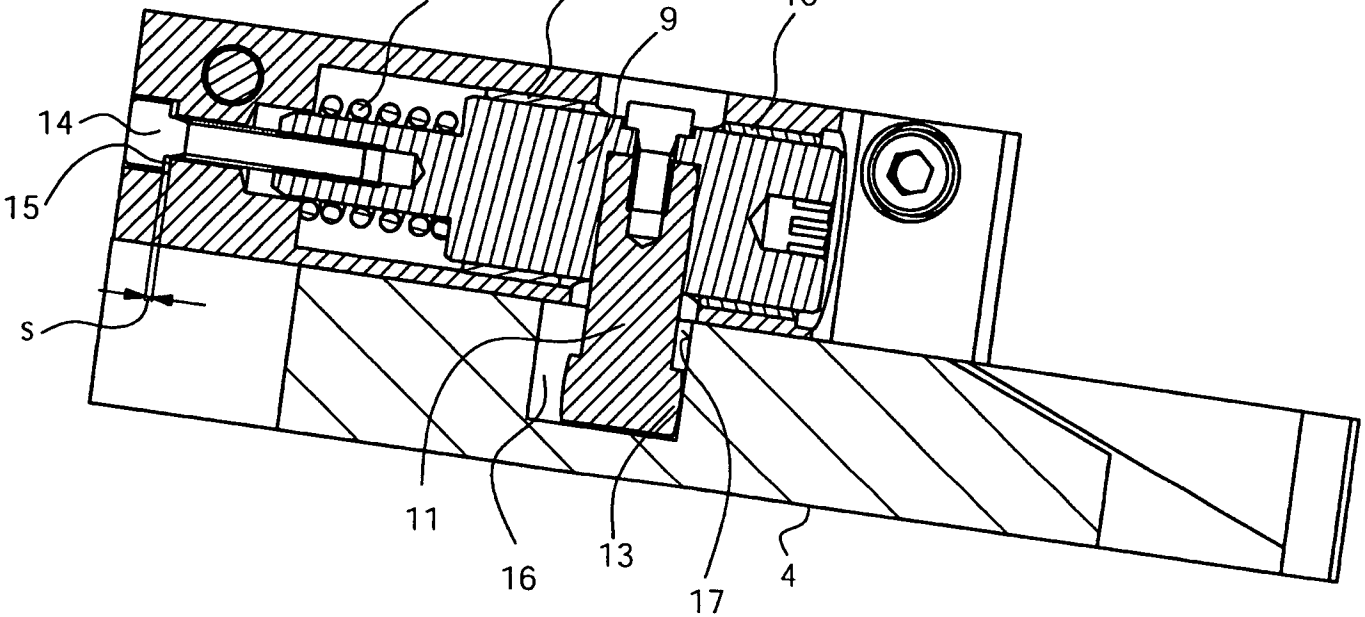
FIG. 4 is an enlarged, mainly sectional view showing the side wall and the actuating element of the ink fountain, which is taken along a line IV-IV of FIG. 3, in the direction of the arrows.

A screw 14 is screwed into the actuating element 9. The screw 14 is disposed coaxially with regard to the longitudinal axis of the actuating element 9 and serves to adjust the position of the actuating element 9 relative to the holder 5. An effective actuating path (see FIG. 4) of the actuating element 9 can be limited and set by the screw 14, the head of which bears against a stop face 15 of the holder 5 when the side wall 4 is set away from the ink fountain roller 8 and therefore in the case of minimum tension or stress of the spring 12.

A side of the side wall 4 facing the actuating element 9 has a pocket 16, into which the transverse pin 11 engages when the side wall 4 is placed onto the basic body 3. The pocket 16 is a blind hole with a bottom, and is considerably larger than the external diameter of the head 13 of the transverse pin 11, as a result of which there is a comparatively great amount of play all the way around between the head 13 and an inner face or wall 17 of the pocket 16 when the basic body/side wall unit has not yet been set against the ink fountain roller, as can be seen in FIG. 2.

The setting-up or making-ready of the ink fountain 2 functions in the following manner: the film or foil 7 is first placed onto the bottom 6 when the basic body 3 is set away from the ink fountain roller 8. Thereafter, the side walls 4 are placed onto the film or foil 7. The pockets 16 are accordingly pushed over the transverse pins 11, but initially still without any contact between the walls 17 and the transverse pins 11. In this connection, the side walls 4 lean against the lateral faces of the holders 5, and the transverse pins 11 protrude from the lateral faces of the holders 5.

Thereafter, the basic body 3 is adjusted, for example swung, together with the side walls 4 which have been placed thereon, towards the ink fountain roller 8 (i.e., from the position shown in FIG. 1 into the position shown in FIG. 3). Herewith, the concavely contoured end faces of the side walls 4 bear against the circumferential face of the ink fountain roller 8, as a result of which the side walls 4 are displaced by the ink fountain roller 8 along the basic body 3 and toward the left hand side with regard to FIG. 3 in the course of the further adjustment of the basic body 3.

As a result, the inside walls 17 of the pockets 16 come into contact with the spherical faces of the heads 13 of the transverse pins 11. The point of contact between the head 13 and the wall 17 is situated, with regard to the thickness of the side wall 4, approximately in the center thereof, with the result that lateral tipping of the side wall 4, which is caused by the contact, is avoided by this application of force on the line of the center of gravity of the body.

In the course of the further adjustment of the unit toward the ink fountain roller 8, the pressure of the side walls 4 on the actuating elements 9 increases more and more at the noted contact points until, due to this pressure, the actuating elements 9 are displaced counter to the action of the springs 12 along an adjusting direction 18 which is determined by the sliding bushings 10.

Due to the fact that the adjusting direction 18, which is represented by a phantom line in FIGS. 1 and 3, falls away towards the ink fountain roller 8 at an acute angle with regard to the bottom 6, the force which is generated by the spring 12 of the respective actuating element 9 and is transmitted via the actuating element 9 to the respective side wall 4 is split into two force components, a force component which is directed toward the bottom 6 and a force component which is directed toward the ink fountain roller 8. The side wall 4 is pressed firmly against the film or foil 7 by the force component which is directed toward the bottom 6, with the result that the film 7 is tightly clamped therebetween. Due to the fact that the force component which is directed to the ink fountain roller 8 may have a magnitude which can be a multiple of, for example, seven times the magnitude of the other force component, the side wall 4 is pressed firmly with the concave end face thereof against the circumferential face of the ink fountain roller 8.

When the actuating elements 9 are displaced, the heads of the screws 14 are respectively raised up from the stop faces 15 by an actuating path s. A gap which is formed by the actuating path s between the respective actuating element 9 and the respective holder 5, more precisely between the screw head and the stop face 15, is at least 0.5 mm and at most 1.0 mm, in the case of a completely closed ink fountain 2 (see FIG. 3). The force which is applied in this case by the respective spring 12 lies between 400 N and 600 N.

Advantages of the illustrated system are also that ink fountains can be retrofitted with a corresponding apparatus in such a way that, in the case of film or foil wear, tensioning of the film or foil 7 is able to be performed in an uncomplicated manner, and that the side walls 4 are automatically firmly clamped as a consequence of the closing movement of the ink fountain 2 and no additional operating step is required for firmly clamping the side walls 4.

The invention claimed is:

1. A method for making ready or setting up an ink fountain of a printing press, the ink fountain having an ink containment space defined by side walls and a bottom surface, the ink fountain having an ink fountain roller, the method comprising the following steps:

setting the side walls of the ink fountain against the ink fountain roller of the ink fountain and thereby tensioning or stressing springs so that the springs press the side walls against the ink fountain roller;

pressing the side walls against actuating elements loaded by the springs upon setting the side walls against the ink fountain roller, for adjusting the actuating elements counter to the action of the springs, the actuating elements being formed as slides;

adjusting the side walls together with a basic body of the ink fountain upon setting the side walls against the ink fountain roller, and placing the side walls onto the basic body of the ink fountain and only into loose engagement with the actuating elements before setting the side walls against the ink fountain roller;

pressing the side walls against the slides upon setting the side walls against the ink fountain roller, and accordingly displacing and guiding the slides in a direction inclined relative to the bottom surface of the ink fountain; and pushing pockets of the side walls over transverse pins of the slides, the pockets being elongated grooves or blind holes considerably larger than external diameters of heads of the transverse pins for allowing the transverse pins to slide in a direction perpendicular to a rotational axis of the ink fountain roller, the transverse pins being oriented transversely relative to the direction inclined relative to the bottom of the ink fountain and parallel to the rotational axis of the ink fountain roller when the side walls are placed onto the basic body.

2. The method according to claim 1, wherein the heads are barrel-shaped heads, pressing the pockets against the barrel-shaped heads of the transverse pins upon setting the side walls against the ink fountain roller.

3. The method according to claim 1, which further comprises carrying out the step of placing the side walls onto the basic body by indirectly placing the side walls onto the basic body, due to the side walls being placed onto an ink fountain film lying on the basic body.

4. The method according to claim 3, which further comprises pressing the side walls against the ink fountain film with the springs, upon the side walls being set against the ink fountain roller.

5. A method for making ready or setting up an ink fountain of a printing press, the ink fountain having an ink containment space defined by side walls and a bottom surface, the ink fountain having an ink fountain roller, the method comprising the following steps:

placing the side walls onto a basic body defining the bottom surface of the ink fountain;

displacing the basic body for setting the side walls of the ink fountain against the ink fountain roller of the ink fountain and thereby tensioning or stressing springs so that the springs press the side walls against the ink fountain roller;

pressing the side walls against slides loaded by the springs upon setting the side walls against the ink fountain roller, for adjusting the slides counter to an action of the springs; and pushing pockets of the side walls over transverse pins of the slides when the side walls are placed onto the basic body, and orienting the transverse pins transversely relative to an adjusting direction of the pins, the pockets being elongated grooves or blind holes considerably larger than external diameters of heads of the transverse pins for allowing the transverse pins to slide in a direction perpendicular to a rotational axis of the ink fountain roller.

* * * * *